United States Patent [19]

Moehlman et al.

[11] Patent Number: 4,623,150

[45] Date of Patent: Nov. 18, 1986

[54] ENVIRONMENTALLY ACCEPTABLE FRANGIBLE TARGET COMPOSITIONS

[75] Inventors: Vernon C. Moehlman; David W. Hicke, both of Joplin, Mo.; George A. Stagg, Jr., Wayne, N.J.

[73] Assignee: Reagent Chemical and Research, Inc., Middlesex, N.J.

[21] Appl. No.: 742,383

[22] Filed: Jun. 10, 1985

Related U.S. Application Data

[63] Continuation of Ser. No. 389,671, Jun. 18, 1982, abandoned.

[51] Int. Cl.[4] ..... F41J 9/16

[52] U.S. Cl. ..... 273/362; 264/319/330

[58] Field of Search ..... 273/362–365; 264/63, 319, 330, 332, 344, 345; 425/348 R, 348 S

[56] References Cited

U.S. PATENT DOCUMENTS

| | | | |
|---|---|---|---|
| 374,938 | 12/1887 | Carman | 264/344 |
| 1,524,567 | 1/1925 | Plews | 264/344 X |
| 2,048,861 | 7/1936 | Haglund | 264/63 |
| 2,103,463 | 12/1937 | Jones | 264/63 X |
| 2,891,281 | 6/1959 | Heinzelman | 425/348 |
| 3,431,598 | 3/1969 | Lueddeke et al. | 425/348 |
| 4,113,817 | 9/1978 | Kroger et al. | 264/330 X |
| 4,119,694 | 10/1978 | Manning | 273/362 X |
| 4,124,550 | 11/1978 | Kobayashi | 273/362 X |

OTHER PUBLICATIONS

*Ceramic Industry Magazine,* Pincus et al. 4–1969, pp. 106–109.

*Primary Examiner*—Paul E. Shapiro

*Attorney, Agent, or Firm*—Lerner, David, Littenberg, Krumholz & Mentlik

[57] ABSTRACT

Projectable, frangible and environmentally acceptable targets are disclosed which are free of pitch, and which are in all respects environmentally acceptable, and furthermore which can be produced by a simple compacting procedure. The targets are produced from an inert filler component, such as limestone or clay, and a binder component which is capable of binding the inert filler component without being heated to its thermal decomposition point, the inert filler component being friable and relatively wettable with a solvent so that agglomerates of the inert filler component, the binder component, and a solvent can be produced, and a target may then be prepared by compression forming such agglomerates. Methods for producing such targets are also disclosed, including providing a mixture of the inert filler component, the binder component, and the solvent, compacting the mixture into the desired form, and drying by driving off the solvent at a temperature below the thermal decomposition point of the inert filler material.

27 Claims, 3 Drawing Figures

COMPRESSED AND SOLIDIFIED COMBINATION OF BETWEEN ABOUT 85 AND 96 WEIGHT PERCENT OF AN INERT FILLER SUCH AS LIMESTONE, GYPSUM, ANTHRACITE AND SAND, AND BETWEEN ABOUT 4 AND 15 WEIGHT PERCENT OF A WATER SOLUBLE AND NON-TOXIC BINDER SUCH AS STARCHES, DEXTRINS, GUMS, GLUES, LIGNINS, WAXES, ALGINATES, COLLOIDAL SILICA, SILICATES, PHOSPHATES, ALUMINATES AND CLAYS

ENVIRONMENTALLY ACCEPTABLE FRANGIBLE TARGET COMPOSITIONS

This is a continuation, of application Ser. No. 389,671 filed June 18, 1982, now abandoned.

FIELD OF THE INVENTION

The present invention relates to projectable and frangible targets. Most specifically, the present invention relates to projectable and frangible targets which are environmentally acceptable, and which can be easily and economically manufactured. Still more particularly, the present invention relates to methods for producing such frangible targets by means of a compacting process.

BACKGROUND OF THE INVENTION

Various composition targets, which are also known as "clay pigeons," are used for trap and skeet shooting. These targets have generally been made in the form of saucer-shaped structures which are molded from suitable mixtures, and most of the commercial targets include petroleum or coal tar pitch as the binder, along with a filler material such as clay or other finely divided minerals, such as limestone, so as to provide a relatively fragile or frangible structure.

These targets are intended to be used by marksmen in such trap and skeet shooting, and therefore must be capable of not only being projected for considerable distances, but must also be capable of disintegrating upon contact with a pellet or pellets and withstand the vigorous action of the trap required to propel the target into the air. If this is not the case, the target will not indicate when the marksman has scored a hit on the target, i.e., unless the target is entirely frangible and shatters upon impact.

In addition, since trap shooting is generally conducted out of doors, where the targets then shatter and fall to earth, environmental acceptability has become a particularly sensitive problem. The shattered targets are thus potentiall eaten by birds and other wild or domesticated animals, and indeed this problem is particularly acute in connection with hogs, which are thus the subject of specific warnings printed on the packing cases for many conventional targets. Furthermore, unless these targets are entirely acceptable from an environmental viewpoint, they can cause many other types of pollution.

Finally, in view of their very nature, it is also essential that these targets be produced at the cheapest possible cost per target, therefore requiring materials of construction which have the most nominal of costs associated with them.

Among the earliest developments in this field were glass balls and the like, which were initially used as targets as shown in U.S. Pat. No. 222,301. In this patent, substitutes for such glass balls are shown, including sodium and potassium silicate targets, which are said to be usable in admixture with a small percentage of sodium carbonate or hydrate and which are employed by melting these components and producing a "soluble glass" target therefrom.

As this art developed, targets were produced from various compositions, including finely divided clay mixed with water, which was then molded and kiln dried. Other materials used were plaster of Paris, sand and pitch, all of which, however, suffered from the various deficiencies discussed above.

At the present time, the most popular composition target in use is one consisting of a composition of ground limestone and pitch, such as is disclosed in U.S. Pat. Nos. 2,831,778 and 3,399,255. Such targets, however, are not only relatively expensive, since pitch has an elevated price structure and requires a rather large energy consumption in manufacturing processes utilizing same, but they are also toxic, very susceptible to changes in temperature, and do not shatter with the proper degree of consistency at various temperatures. Such targets are not environmentally degradable, thereby causing serious concern with respect to the environment, and the possibility of harm to animal life, particularly hogs, as discussed above. Targets have also been produced from sulfur, and sulfur combined with various additives, in an attempt to replace the conventional pitch and limestone or clay targets. Thus, in Canadian Pat. No. 959,203 and U.S. Pat. No. 3,884,470 the patentee discusses such a sulfur target composition, which in that case is made by melting the sulfur composition and injection molding the targets therefrom.

Further improvements in such targets have also been attempted, such as that in U.S. Pat. No. 3,840,232, in which targets are molded from mixtures of elemental sulfur and limestone dust as an inert filler. These targets are produced by initially heating to produce a fluid mix, and then molding. The inclusion of materials such as bentonite clay, which are materially unstable in the presence of water, are also disclosed as producing environmentally degradable targets in that environment.

Finally, other attempts have been made to produce targets from synthetic materials, such as those in Japanese Pat. No. 52-48300, which includes low molecular weight thermoplastic resins such as polystyrene, along with high molecular weight thermoplastic resins such as polyethylene, in combination with inorganic fillers such as calcium carbonate, clay, etc., and U.S. Pat. No. 3,554,552 in which such targets are produced from compositions of polystyrene and polyethylene waxes.

Yet another approach to the production of such targets while at the same time reducing the amount of pitch present as a binder therein, is set forth in a series of patents to Moehlman et al, namely U.S. Pat. Nos. 3,399,255; 3,376,040; and 3,577,251. In these patents, a process for reducing the pitch content of these targets is set forth in which, in various embodiments, specific procedures are employed in order to coat the inert filler or limestone component with pitch or tar, and to then compression mold targets therefrom. In this manner, the patentee attempts to reduce the pitch content down to between about 8 and 25 percent thereof.

It is therefore an object of the present invention to overcome these deficiencies of the prior art, and to thus produce a frangible, projectable target which does not suffer from the disadvantages of these prior art targets. In particular, it is an object of this invention to produce such a target easily and economically, from materials which are far less expensive than those previously utilized.

SUMMARY OF THE INVENTION

In accordance with the present invention, it has now been discovered that these and other objcts can now be realized by producing a projectable and frangible target which is entirely free of pitch, which is environmentally acceptable, and which furthermore meets all of the above-noted requirements. The target of this invention thus includes an inert filler component as well as a binder component capable of binding the inert filler component without the necessity of heating the binder component to a temperature above its melting point, preferably in amounts of between about 4 and 15 weight percent, based on the overall compositions. The inert filler component is friable and relatively wettable with a solvent, so that agglomerates of the inert filler component, the binder component, and the solvent can be produced, and a target may be prepared by compression forming those agglomerates.

In accordance with a preferred embodiment of the targets of the present invention, the inert filler component is present in an amount of between about 85 and 96 weight percent. Preferably, the inert filler component is limestone, gypsum, anthracite, sand, and/or other such inert filler materials.

In accordance with a preferred embodiment of the targets of the present invention, the binder component is an organic or an inorganic binder, and it preferably comprises a compound such as starch, lignin or various ligno-sulfinates, cellulosic materials, various natural and synthetic resins, and the like. Among the inorganic binders which can be employed are various clays, bentonites, phosphates, soluble silicates, aluminates, and the like.

In accordance with a preferred embodiment of the targets of the present invention, agglomerates from which the targets are compression molded are utilized which have an average particle size distribution of between about 12 mesh and 200 mesh. Preferably, the binder component used in these targets will have a thermal decomposition point of less than about 500° F.

In accordance with another embodiment of the present invention, a method is provided for producing such frangible and projectable targets. The method of this invention includes providing a mixture of an inert filler component, a binder component, preferably in amounts of between about 4 and 15 weight percent, and a solvent, in order to produce agglomerates of the inert filler component, compacting that mixture into the desired form of a target, and drying the compacted target by driving off the solvent at a temperature below the thermal decomposition point of the inert filler component. Preferably, the drying step is conducted at an elevated temperature below the thermal decomposition point of the binder component. In one embodiment, however, the drying step is carried out substantially at room temperature, e.g., employing a stream of air thereacross.

In accordance with one embodiment of the method of the present invention, the compacting step is carried out at a pressure of between about 5 and 50 tons.

In accordance with another embodiment of the method of the present invention, the step of providing the mixture to be compacted includes dissolving the binder component in the solvent, and subsequently combining the combined binder component and solvent with the filler component, so that the agglomerates thus produced are particles of the filler substantially coated with the binder dissolved in the solvent. Preferably these agglomerates have an average particle size of between about 16 and 200 mesh.

In accordance with another embodiment of the method of the present invention, the compacting step includes pressing the mixture between first and second die members, and includes moving both the first and second die members in a common predetermined direction during the compacting step.

DETAILED DESCRIPTION

Figure 1:
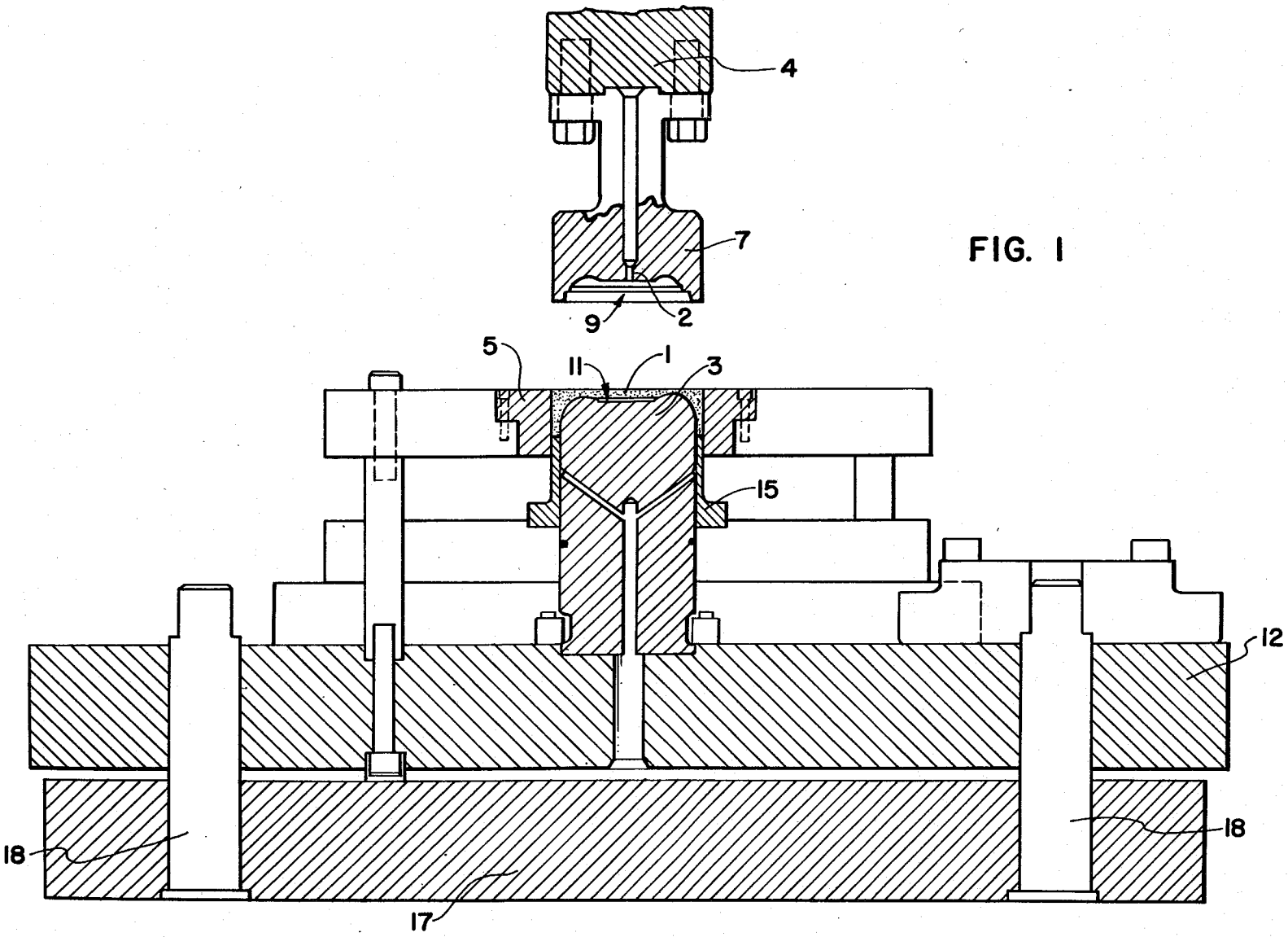
FIG. 1 is a side, sectional, elevational view of an apparatus for producing the targets of the present invention.
Figure 2:
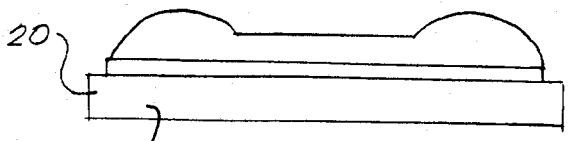
FIG. 2 is a side elevational view of a target of the present invention.
Figure 3:
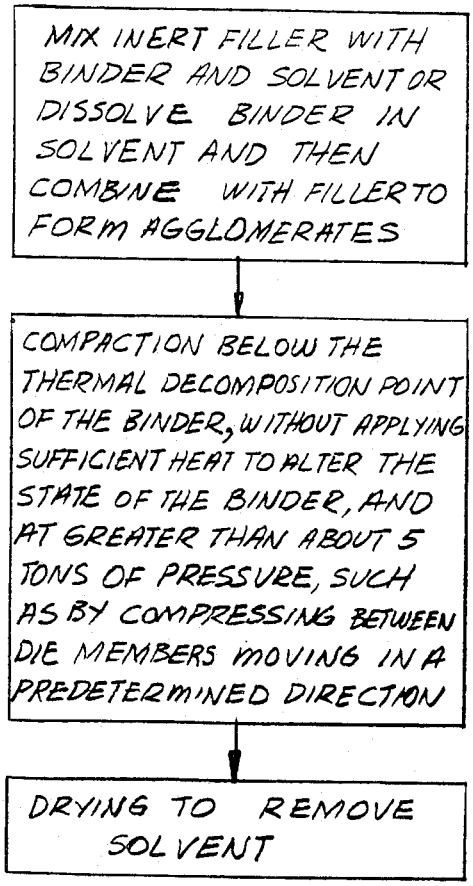
FIG. 3 is a flow chart showing the method steps of the present invention.

The primary significance of the present invention arises from the fact that now, for the first time, it is possible to utilize conventional inert filler components without having to add to these expensive and/or environmentally harmful components, as has always been necessary in order to produce such frangible and projectable targets therefrom. This can thus now be done without the need to include materials such as pitch in the composition in order to produce targets which not only meet the above requirements with respect to ease and economy of manufacture on readily available equipment, but which also possess the required degree of frangibility to provide excellent targets for the purposes hereof.

An understanding of this invention must therefore begin with an appreciation for the fact that the principal component thereof, namely the inert filler component, has of course been the object of extensive use in the past, albeit in combination with other ingredients such as pitch, which are expensive and/or environmentally harmful. It is only in accordance with this invention that ingredients such as pitch can be completely eliminated. Aside from the expense and environmental harmfulness of pitch itself, that substance also indirectly increases the costs of targets utilizing same by increasing the energy requirements inherent in such processes. That is, in such processes large amounts of energy are expended in maintaining the pitch at a high enough temperature so that it can be properly molded, and at the same time in subsequently cooling down the molded, pitch-containing targets. For example, in order to attain acceptable production rates, it has been necessary to expend additional energy in utilizing water chilled below room temperature in order to cool down the molded target for further processing.

The most commonly used filler material employed in the past for these purposes has been ground limestone, although other materials such as clay have also been utilized to a significant degree. It is within the scope of this invention, however, to use other such inert filler materials, such as gypsum (calcium sulfate), powdered anthracite, fine sand, and other inert filler materials which otherwise meet the requirements of the present invention. These include not only the fact that this material must be inert with respect to the other ingredients employed, but that is must also be relatively inexpensive, it must produce a frangible target, it must preferably have a relatively smooth surface, and it must be friable and capable of being wetted by a solvent, such as water, in order to form agglomerates with the binder materials mentioned below.

The principal purpose of the binder component is to render the inert filler component susceptible to the formation of agglomerates, which in turn can then be properly compressed or compacted so that an acceptable target can then be formed therefrom. This invention contemplates the use of a number of such binder materials, as long as they are properly utilized in an appropriate method for producing these targets. Thus, an appropriate such binder material will ideally confer adequate wet and/or dry bond strength between binder and inert filler material, contribute to the formability of the ultimate product, prevent sticking to the dies and molds which are used to compact the final target, while not abrading or corroding the die itself, will blend readily with the inert filler material, and be non-toxic, reproducible, reasonably inexpensive, and effective in relatively low concentrations. In many respects, these properties correspond to desired properties for binders used in other fields, such as in the field of ceramic processing. In this respect, reference is made to an article entitled "The Role of Organic Binders in Ceramic Processing" by Pincus et al, in *Ceramic Industry Magazine,* April 1969, pages 106 through 109. The various materials which have been suggested for use as such binders have thus included materials which can be used in connection with the present invention, along with a considerable number of other materials which could not be used in connection with this invention, for reasons such as costs, toxicity, etc. The reason for this is that binders used in ceramic processing, while useful for many of the same reasons for which they are useful in connection with the present invention, are at the same time intended to be used in an environment which includes a later firing step, in which the ceramic material is fired at temperatures far above the melting point and the decomposition point of the binder. In those processes, the binder is, in effect, totally eliminated, and at the very least is often (after firing) no longer necessary for any purposes. The reason for this is that in ceramic processing, the ceramic material is heated above its own melting point and fuses. This can be dramatically contrastated to the present invention, in which, as is discussed in more detail below, a final drying step is used in which at least a portion of the solvent used in connection with the binder is driven off during drying, but where preferably no temperatures above the thermal decomposition point of either the binder or the inert filler material are used and/or necessary therein. Thus, during the drying step of the present invention not only is the binder used herein not driven off at temperatures above its thermal decomposition point, but it is solidified into a much harder "glue-like" material, which is extremely important in connection with the overall preparation of the final targets hereof.

The particular binders which can thus be employed in connection with this invention include various organic binders, including starches, such as corn, waxy maize, tapioca, sago, and potato starch; dextrines; sugars; glues; gums, such as arabic, tragacanth, guar, locust bean, xanthan, karaya, red, sevco and cellulose gums; lignins, such as the lignosulfanates; alginates, such as the alkali metal alginates, e.g., sodium alginate, and ammonium alginate; waxes, such as the soluble paraffins, petroleum, microcrystalline and synthetic waxes; waxy esters; cellulosic compounds, such as sodium carboxymethylcellulose, methylcellulose and hydroxy-propylmethylcellulose; and various synthetic resins, such as polyvinyl chloride, acrylics, urea-formaldehyde, polyesters, polyvinylpyrrolidone, polyethylene oxide, cellulose acetate, latexes, etc. In addition, various inorganic binders can also be employed, such as colloidal silica and various silicates, and clay materials, such as bentonite, phosphates, aluminates, etc.

A most significant step in the preparation of the targets of this invention involves the preparation of agglomerates of the inert filler component, i.e., a molding power or granules from which the ultimate targets will be manufacured by compacting. Such agglomerates or molding granules are prepared by combining the binder component with a solvent and then coating the particles of inert filler material with the binder so as to produce such agglomerates. There are a number of parameters in connection with this preparation, which become extremely imporatnt when viewed in connection with the ultimate targert properties which are desired, including the ultimate appearance of the target, its green strength (i.e., immediately after molding, but prior to drying), its frangibility, dimensional stability, temperature sensitivity, etc. Thus, the purpose of the solvent is to disperse the binder, to fully coat the inert filler component particles therewith, and to provide a tacky or sticky interface which provides acceptable green strength upon compacting, and ultimately forms solid bridges upon the drying thereof. Various solvents can be utilized, including organic solvents such as xylene, toluol, alcohols, methyl ethyl ketone, trifluoroethylene, etc., and inorganic solvents such as water. The most preferable solvent for use in connection with this invention is water.

In the preparation of the agglomerates or molding granules, between about 11 and 16 weight percent of the solvent is generally combined with between about 4 and 15 weight percent of the binder material, and more preferably between about 4 and 10 weight percent of the binder material. Preferably, between about 9 and 12 weight percent of the solvent, such as water, will be utilized. However, there is leeway in the precise amounts of these components. That is, the overall binder concentration should be such that there is enough binder present to form these agglomerates, i.e., to coat the inert filler particles to an extent such that sufficient green strength will result in compacting, and sufficient integrity will result on drying. However, a coarser filler component will require less binder, while a finer particle size filler component will require a greater amount of binder. Furthermore, the amount of solvent which will be required in order to obtain the efficient dispersion of binder will also vary, depending upon the size of the filler particles, as well as the physical behavior of the binder upon its dilution. For example, with a very viscous binder dissolved in a solvent, such as the starches, more solvent will be required in order to coat the filler particles in a way that the desired agglomerates will thereby be formed. In any event, a principal object of this step is to produce a binder having the proper consistency for subsequent mixing with the inert filler component. Thus, in some cases where a liquid binder is utilized, there may be no need to add any additional solvent thereto at all. Such liquid binders may thus include the liquid lignins, starches, silicates, emulsified waxes, or certain synthetic resins, such as ethylene vinyl acetate, etc.

In any event, the overall liquid composition of the binder is between about 4 and 10 weight percent. It is then possible to combine this binder in its semi-liquid form with the inert filler component. This is accomplished using various commercial mixing devices, in order to thoroughly coat the inert filler component. The agglomerates thus formed comprise relatively small masses of the inert filler component, which are now soft and easily deformable when compressive forces are applied thereto. These masses generally have a size of between about 16 mesh and about 200 mesh, preferably between about 20 mesh and about 100 mesh. The shape of these masses, which is determined not only by the nature of the inert filler component and binder utilized, but also by the amount of solvent used and/or the fluidity of the binder, can in turn effect the overall rheology of these agglomerates, including their flowability, bulk density, compaction ratio, and other packing characteristics. Preferably, the mixing of these components is carried out in a ribbon or sigma blade mixer in which torque or shear can be applied to the mix. A preliminary drying step can then be carried out, in which the liquid content of the agglomerates is adjusted to between about 1 and 6 weight percent, and preferably between about 1 and 2 weight percent, again depending upon the binder utilized. The agglomerates are then ready for compacting. However, prior to this step it is also possible to apply the agglomerates to a screening procedure in order to insure that the overall agglomerates or particles are within a desired particle size range, as discussed above. This can be done by granulation through a screen in a conventional granulator, or by other such methods.

In any event, the agglomerates are then ready for compacting into the ultimate target by means of apparatus such as that shown in FIG. 1, which will now be referred to in more detail. It should be understood, however, that variations on this apparatus can also be utilized. For example, both toggle presses and hydraulic presses, such as that shown in FIG. 1, have been employed to date.

Referring specifically to FIG. 1, it can be seen that the agglomerate mix 1 is applied to a lower inner punch cavity 3, and contained within a surrounding die 5. The mix is fed to the dies by means of conventional feeding equipment, but more consistent results have been found by vibration of the feed material as it enters the die, and by preventing any material from being drawn out of the die casting. Ultimate compacting will thus take place between the lower inner punch 3 and the upper punch 7, which is formed in one piece having a lower surface 9 which includes a mold having a shape corresponding to the desired shape of the upper surface of the target to be produced. An optional pin 2 protrudes from the top, center of this upper punch 7 so as to form a small hole at the top, center portion of the target itself. This can therefore provide venting, i.e., so that a vacuum is not created thereunder, and thus assists in release of the target from the lower inner punch 3. Of course, other apparatus could be used for this purpose, such as means for creating a positive flow of air or other gas, etc. In any event, the upper face 11 of the lower inner punch 3 includes the corresponding shape of the lower surface of the target to be produced. The overall lower mold, however, is provided by two elements, i.e., lower outer punch 15 along with lower inner punch 3. The lower outer punch 15 is in the form of an annular ring, which not only forms the lower end of the target edge, but which, when activated, acts to eject the target from the mold. Furthermore, this annular ring can be adjusted up or down so as to control the ultimate dimensions of the lower edge of the target, or the "driving band" area thereof. Compacting is accomplished by activation of ram 4 so as to move upper punch 7 into the die against the mix 1 and the upper surface 11 of the lower inner punch 3. The mix 1 is applied to the upper surface 11 of the lower inner punch 3, as shown in FIG. 1, preferably in as smooth and even a distribution as possible.

The lower inner punch 3, in turn, is attached to a hydraulic cylinder. In particular, it rests upon a cushion plate 12 which is fixed to a bolster 17 by means of a pair of hydraulic cylinders 18. In this manner, when the upper punch 7 is activated by ram 4, it moves towards the lower inner punch 3, at a predetermined upper punch pressure. At upper punch pressures of between about 5 and 50 tons, pressure of between about 3 and 45 are employed as the predetermined lower punch pressure in the upward direction, with the upper punch pressure being greater than the lower punch pressure. Furthermore, the differential between these upper and lower punch pressures can be adjusted so as to obtain the desired density of the target obtained therefrom. In any event, when these two force vectors meet, the greater downward pressure on the upper punch 7 will overcome the lesser upward pressure on the lower inner punch 3, and the lower inner punch 3 will then be caused to also move downward. As this occurs, the agglomerates or granules between the punches will be distributed (or "flow") in an inward direction, i.e., away from the lower rim and "driving band" area of the target, and this will in turn cause an increase in the density of the target in the lower portion of the "dome" area thereof, and will also prevent dusting of the mix out of the die.

The importance of the average particle size of the agglomerate mix contained in the molds of this apparatus can now be more readily appreciated. That is, with particle sizes of less than about 100 mesh, there will be an inability of the material to "flow" within the mold during compacting. It will thus not have the ability to produce a target having a uniform density distributed throughout its surface. In addition, during compacting under extreme pressures in this manner, and with an agglomerate mix having too low a particle size, laminations will occur, thus seriously weakening the ultimate strength and other properties of the target. Such a mix is referred to as a "dead mix," for obvious reasons. On the other hand, with particle sizes greater than about 16 mesh, a target having a smooth outer surface will not be produced therefrom, and laminations can again occur if the compacting pressure is too great. Furthermore, there will also be locally decreased density areas produced in the target again adversely affecting its physical properties.

It should again be noted that while the particle size of the agglomerates is quite important, it is only one of the factors which must be considered in producing an acceptable target product. The other factors have been discussed above, and include the moisture content of the mix being compacted, the nature and quantity of the binder and of the inert filler material, etc. Most preferably, an ideal agglomerate mix will have a relatively wide distribution of granule size which, however, will be between about 16 and 200 mesh, and primarily having a particle size between about 16 and 100 mesh. It is also preferred that these granules have a sufficient degree of softness so as to deform under the pressure exerted in the mold and produce a product having adequate green strength. It should also be noted that if the relative moisture content of the agglomerate particles placed in the mold is too high, an exudate will appear on the surface of the tooling during compacting. This exudate will consist of the binder material having too high a moisture content. This can also result in the target product breaking into more than one piece when the upper and lower punch elements separate in the die cavity, etc.

It may also be necessary or desirable to include additional ingredients in the target compositions hereof. Thus, numerous lubricants, coloring agents or pigments, wetting agents, and other such additives can be included in the mix. For example, with the use of binders such as various gums, alginates, starches, sugars, caseins, etc. various preservatives or biocides might be necessary. Also, the inclusion of water retention agents, anti-static agents, anti-foaming agents, chelation agents, sequestering agents, and the like may be required in these target compositions. This will depend on the nature of the binder material used, and its physical and chemical properties. Of significance is the fact that targets of various colors can easily be made by merely combining the desired pigment in the mix prior to compacting. The targets can also be made to be waterproof by including various reactive resins which will form a continuous film on drying, as they react, such as various polyesters, urea formaldehyde resins, solvent soluble resins and waxes, acrylics, etc. therein. In addition, they can be produced in a fluorescent condition by adding suitably prepared dyes thereto, etc. For example, internal lubricants can be added to these compositions to assist in release from the tooling, and to enhance their rheology as the agglomerates move within the mix. This can be especially advantageous when one is attempting to form a target across a radius, or at right angles, etc. Examples of typical such lubricants are stearates, such as diglycol stearate, magnesium stearate, zinc stearate, calcium stearate, aluminum stearate and stearic acid, as well as various waxes, polyethylene glycols, graphite, etc.

Wetting agents can be utilized to more efficiently distribute the binder onto the surface of the inert filler particles, and in some instances to also enable one to reduce the overall amount of binder utilized. These wetting agents can include compounds such as tergitol and other such surfactants.

Plasticizers can also be added to these compositions in order to render the mix more plastic in nature, or to keep the mix sufficiently soft so that the granules or agglomerates are deformable under the pressure to be applied thereon. These plasticizers thus often replace small quantities of moisture contained in the mix. They must, however, be of a nature which will be volatilized during the drying operation. When these targets have been dried, as indicated above, they become hard and rigid, and such compatable plasticizers can be added to obviate this condition to some extent. Specifically, such plasticizers can include the phthalates, adipates, glycerine, ethylene glycol, etc.

Various biocidal agents can also be incorporated in some of the mixes hereof. For example, all of the carbohydrate binders hereof will be susceptible to degradation by bacterial action or by the action of fungi in the solution. Also, natural gums are very susceptible thereto. Such biodegradation can, in turn, result in a reduction in the molecular weight of the binders, and therefore reduce the solution viscosity. Examples of such biocides include phenols, sodium benzoate, etc. On the other hand, materials such as the acrylics, polyethylene oxides and polyvinyl acetates are not susceptible to such biodegradation, and therefore in such cases it will not normally become necessary to include any such biocides in the mix.

Finally, gelling agents can also be incorporaed in the mix. These gelling agents can be used to contain the binder in the mix during the pressing thereof. That is, they tend to increase the viscosity of the remaining binder-solvent concentration prior to the compacting step, so that the binder will therefore not tend to exude from the mix, and onto the tooling. Examples of typical such gelling agents include the natural and synthetic gums, etc.

After the compacting step is completed, the targets must then be dried, i.e., so as to remove a substantial amount of the solvent therefrom. As noted above, however, this drying step is a limited drying step, and is conducted at a temperature below the thermal decomposition point of the inert filler component. It is essential that temperature conditions not be utilized which will tend to eliminate the binder, again such as is the case in ceramic processing as discussed above. If that takes place, the resultant targets will be essentially useless.

In any event, the drying can be accomplished in a number of ways, such as the use of a conventional gas or quartz infrared heaters, convection heaters, microwave heaters, etc. From this procedure a fused, coherent, and frangible structure is produced. On the other hand, the drying step can be conducted essentially at room temperature, or at only slightly elevated temperatures, and can be assisted by blowing a stream of air or other such gas across the targets to assist therein.

While there are a large number of preferred compositions which fall within the scope of the present invention, including compositions which may be highly advantageous from certain points of view but less advantageous from others, such as from the point of view of cost and other such factors which might only preclude their commercial use from a practical viewpoint, a number of the more preferred compositions within the scope of this invention are set forth below so as to more fully describe the basic underlying concepts of this invention.

For example, starch has been employed as a binder in connection with limestone and gypsum as the inert filler component. In particular, the starch is dissolved in hot or warm water, and mixed until a smooth gel or gel-like solution results. This starch solution is then added to the filler component and this mix is mixed and then dried until it has a moisture content of between about 2 and 6%. The mix is then granulated through an appropriate size screen in order to yield a particle size range distribution of between 16 and 200 mesh. In particular, with the use of a coarse limestone or gypsum filler component, a 6% binder concentration is used with a water content of 8%. With a fine limestone or gypsum filler component, an 8 to 10% binder concentration is used, with a water content of between about 10 and 12%. In each case, from about 0.5 to 1% of zinc stearate is added in order to assist in the flow of the mix and and in its release from the tooling.

Both powdered and liquid lignin have also been employed as the binder in preferred compositions hereof. Thus, with the liquid lignin binder, the concentration of the binder in water is adjusted in order to yield the appropriate amount of solvent for the particle size of the inert filler which is to be utilized. Thus, with a fine particle size filler (again such as limestone, gypsum, etc.) a greater concentration of the lignin is required, and a greater amount of solvent (water) is needed in order to properly coat the larger surface area of this filler component. On the other hand, mixing of the dry ingredients and then adding water thereto is a far less efficient mixing procedure as compared to that of mixing a liquid binder. In any event, with the coarser particle size fillers, these have been mixed at lignin binder concentrations of from about 4 to 6%. With the finer particle size fillers, however, mixing at lignin binder concentrations of from about 5 to 10% have been particularly successful. The overall solvent concentrations are generally at about 10%, and then reduced to a range of between about 1 and 6%. Again, from about 0.5 to 1% of zinc stearate is added, and the mixes are then screened through a 12 mesh screen in order to obtain agglomerates in the 12 to 200 mesh particle size range.

Finally, sodium silicate or waterglass has also been used as the binder herein. Solutions of up to 10% concentrations have been employed with both coarse and fine inert filler components. Thus, as the particle sizes of the fillers become smaller, more water was added to the sodium silicate. While a substantial portion of the initial 12 to 14% moisture content was evaporated prior to screening, it was found that a water concentration of between about 1 and 2% was preferable during the compacting operation. The rather large, hard agglomerates thus formed were granulated through a 14 mesh screen, and particles larger than about 16 mesh were recycled.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. A projectable and frangible target comprising an inert filler component and between about 4 and 15 weight percent of a solidified naturally occurring water soluble binder component, said binder component being substantially non-toxic to animals, and being capable of forming agglomerates with said inert filler component without heating, said target being free of pitch, and said inert filler component being friable and relatively wettable with a solvent, whereby agglomerates of said inert filler component, said binder component, and said solvent can be produced, said target including said binder component being prepared by the compression forming of said agglomerates and the subsequent drying of said compressed targets so as to solidify said binder and produce a hardened and rigidified target which is capable of withstanding the forces created by propulsion of said target by means of a trap while also being capable of disintegration upon impact by a projectile.

2. The target of claim 1 wherein said inert filler component is present in an amount of between about 85 and 96 weight percent.

3. The target of claim 1 wherein said inert filler component is selected from the group consisting of limestone, gypsum, anthracite, sand, and mixtures thereof.

4. The target of claim 1 wherein said naturally occurring binder component is selected from the group consisting of starches, dextrins, gums, glues, lignins, waxes, alginates, colloidal silica, silicates, phosphates, aluminates, clays, and mixtures thereof.

5. The target of claim 1 wherein said agglomerates have an average particle size of between about 16 and 200 mesh.

6. The target of claim 1 wherein said solvent comprises water.

7. The target of claim 6 including between about 1 and 6 weight percent of said water upon said compression molding.

8. A projectable, frangible and environmentally acceptable target comprising an inert filler component and between about 4 and 10 weight percent of a solidified, naturally occurring water soluble binder component capable of forming agglomerates with said inert filler component without heating said binder component, said target being free of pitch, and said inert filler component being friable and relatively wettable with a solvent, whereby agglomerates of said inert filler component, said binder component, and said solvent can be produced, said target being prepared by the compression forming of said agglomerates at pressures of greater than about 5 tons and the subsequent drying of said compressed targets so as to solidify said binder and produce a hardened and rigidified target which is capable of withstanding the forces created by propulsion of said targets by means of a trap while also being capable of disintegration upon impact by a projectile.

9. The target of claim 8 wherein said inert filler component is selected from the group consisting of limestone, gypsum, anthracite, sand, and mixtures thereof.

10. The target of claim 8 wherein said binder component comprises a naturally occurring binder component selected from the group consisting of starches, dextrins, gums, glues, lignins, alginates, waxes, clays, phosphates, silicates, aluminates, and mixtures thereof.

11. A method of producing a projectable and frangible target comprising providing a mixture of an inert filler component, between about 4 and 15 weight percent of a binder component, and a solvent, so as to produce agglomerates of said inert filler component, compacting said mixture into the desired form of said target without the application of sufficient heat to alter the state of said binder component, and drying said compacted target by driving off said solvent at a temperature below the thermal decomposition point of said inert filler compound so as to solidify said binder and produce a hardened and rigidified target which is capable of withstanding the forces created by propulsion of said target by means of a trap while also being capable of disintegration upon impact by a projectile.

12. The method of claim 11 wherein said compacting is carried out at a pressure of between about 5 and 50 tons.

13. The method of claim 11 wherein said drying is carried out at an elevated temperature below the thermal decomposition point of said binder component.

14. The method of claim 11 wherein said step of providing said mixture comprises dissolving said binder component in said solvent, and subsequently combining said binder component dissolved in said solvent with said filler component, whereby said agglomerates comprise particles of said filler component substantially coated with said binder component dissolved in said solvent.

15. The method of claim 14 wherein said agglomerates have an average particle size of between about 16 and 200 mesh.

16. The method of claim 11 wherein said compacting comprises pressing said mixture between first and second die members, and including moving both said first and second die members in a common predetermined direction during said compacting step.

17. The method of claim 11 wherein said mixture comprises between about 85 and 96 weight percent of said inert filler component.

18. The method of claim 11 wherein said inert filler component is selected from the group consisting of limestone, gypsum, anthracite, sand, and mixtures thereof.

19. The method of claim 11 wherein said binder component comprises a naturally occurring binder component.

20. The method of claim 19 wherein said naturally occurring binder component is selected from the group consisting of starches, dextrins, gums, glues, lignins, waxes, alginates, clays, phosphates, silicates, aluminates, and mixtures thereof.

21. The method of claim 11 wherein said solvent comprises water.

22. The method of claim 21 wherein said mixture includes between about 1 and 6 weight percent of said water upon said compacting.

23. The method of claim 11 wherein said drying is carried out substantially at room temperature.

24. The method of claim 23 wherein said drying includes a stream of air.

25. A method of producing a projectable, frangible and environmentally acceptable target comprising providing a mixture of an inert filler component, a binder component selected from the group of organic and inorganic binder components, and a solvent, so as to produce agglomerates of said inert filler component, compacting said mixture into the desired form of said target, and drying said compacted target by driving off said solvent at a temperature below the thermal decomposition point of both said inert filler component and said binder component.

26. The method of claim 25 wherein said compacting is carried out at a pressure of between about 5 and 50 tons.

27. The method of claim 25 wherein said mixture includes between about 4 and 10 weight percent of said binder component.

* * * * *